US009205902B2

(12) United States Patent
Sylvia et al.

(10) Patent No.: US 9,205,902 B2
(45) Date of Patent: Dec. 8, 2015

(54) EXTERNAL PAYLOAD MODULE FOR AN AUTONOMOUS UNDERWATER VEHICLE

(71) Applicant: LOCKHEED MARTIN CORPORATION, Bethesda, MD (US)

(72) Inventors: Russell M. Sylvia, South Dartmouth, MA (US); Martin C. Lewis, Plymouth, MA (US); Robert P. Gordon, Jr., North Attleboro, MA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 14/184,930

(22) Filed: Feb. 20, 2014

(65) Prior Publication Data

US 2014/0230714 A1 Aug. 21, 2014

Related U.S. Application Data

(60) Provisional application No. 61/767,021, filed on Feb. 20, 2013.

(51) Int. Cl.
*B63G 8/00* (2006.01)

(52) U.S. Cl.
CPC ..... *B63G 8/001* (2013.01); *Y10T 29/49716* (2015.01)

(58) Field of Classification Search
CPC ..... B63G 8/00; B63G 8/001; B63G 8/42; B63B 21/66
USPC ..... 114/321, 322, 316
See application file for complete search history.

(56) References Cited

U.S. PATENT DOCUMENTS

| | | | | |
|---|---|---|---|---|
| 4,805,549 | A | 2/1989 | Svenning et al. | |
| 5,235,931 | A * | 8/1993 | Nadolink | 114/321 |
| 5,995,882 | A | 11/1999 | Patterson et al. | |
| 6,376,762 | B1 | 4/2002 | French et al. | |
| 6,427,615 | B1 | 8/2002 | Ku | |
| 6,484,660 | B1 | 11/2002 | English | |
| 6,581,537 | B2 | 6/2003 | McBride et al. | |
| 6,698,373 | B2 | 3/2004 | Geriene et al. | |
| 6,854,410 | B1 | 2/2005 | King et al. | |
| 6,901,876 | B2 | 6/2005 | Geriene et al. | |
| 7,013,827 | B2 | 3/2006 | Harland-White | |
| 7,721,669 | B1 | 5/2010 | Portmann et al. | |
| 7,753,315 | B2 | 7/2010 | Troy | |
| 8,539,898 | B1 | 9/2013 | Sylvia et al. | |
| 2009/0107388 | A1 | 4/2009 | Crowell et al. | |
| 2011/0226174 | A1 | 9/2011 | Parks | |
| 2012/0099399 | A1 | 4/2012 | Lichter et al. | |

* cited by examiner

*Primary Examiner* — Lars A Olson
(74) *Attorney, Agent, or Firm* — Hamre, Schumann, Mueller & Larson, P.C.

(57) ABSTRACT

An external payload module or body that is mechanically attached to the exterior of a standard production AUV. The module expands the applications for which the AUV can be utilized and/or enhances an existing application(s), enabling current single or limited use AUV's to have multi-mission capability or enhancing existing capability without requiring complete redesign of the AUV. This approach capitalizes on the advantages of high-volume small AUV production to maintain low manufacturing and handling costs, while enabling greatly improved AUV mission flexibility.

15 Claims, 2 Drawing Sheets

EXTERNAL PAYLOAD MODULE FOR AN AUTONOMOUS UNDERWATER VEHICLE

FIELD

This disclosure relates to an autonomous underwater vehicle (AUV) and to an external payload module that is attachable to the AUV.

BACKGROUND

Autonomous Underwater Vehicles (AUVs) continue to increase in capability and applications. The ideal AUV would be low cost, small in size and capable of carrying at least double its weight. Due to volumetric constraints and necessary payloads, however; AUV's that are capable of completing multiple missions require significantly larger size, and associated costs. These costs include launch and recovery logistics, material handling and training Smaller AUV's, although less costly, are more limited due to smaller available volumes, and become effectively application specific. The smaller the AUV, the less payload capability it has, while the size of an AUV is directly proportional to cost. Historically, standard production AUV's have been developed for application specific tasks and rarely can be used to perform other tasks.

SUMMARY

This invention utilizes an external payload module or body that is mechanically attached to the exterior of a standard production AUV. The module expands the applications for which the AUV can be utilized and/or enhances an existing application(s), enabling current single or limited use AUV's to have multi-mission capability or enhancing existing capability without requiring complete redesign of the AUV. This approach capitalizes on the advantages of high-volume small AUV production to maintain low manufacturing and handling costs, while enabling greatly improved AUV mission flexibility.

The external module can have various payloads and capabilities depending upon a number of factors including the intended missions. The external module can have one or more sensors including, but not limited to, depth and/or navigation sensors. The external module can have data processing capability provided by one or more data processors. The external module can have one or more power supplies including, but not limited to, batteries. The external module can be equipped with communication equipment for transmitting and/or receiving signals. The external module can include control surfaces including, but not limited to, controllable steering fins, or other steering capability, for providing enhanced steering control to the combined AUV and module. One or more of these features can be provided depending upon the intended mission.

However, it is preferred that the external module not include its own propulsion capability. Rather, once mechanically attached to the AUV, the propulsion mechanism of the AUV will be used to propel the combined AUV/module through the water.

The external module can be watertight to protect the payload that it carries. The external module can also be designed to maintain the mass balance of the AUV. In addition, the module can be designed to mirror the hydrodynamic characteristics of the AUV.

In an optional embodiment, there can be one or more I/O connections between the AUV and the module to provide data and communications interface between the two. The I/O connection(s) can be wireless, for example using a suitable short range radio communication technology, or wired, for example using one or more Ethernet connections. The I/O connection(s) can occur automatically upon connecting the AUV to the module, and/or require manual connection.

In another optional embodiment, there can be one or more power connections between the AUV and the module to provide power from the module to the AUV or to provide power from the AUV to the module. The power connection(s) can occur automatically upon connecting the AUV to the module, and/or require manual connection.

In one exemplary embodiment, the external module is an intelligent module which, when attached to the AUV, automatically assumes control of the AUV's guidance and control system. By changing the design of the module, single-use AUV's can be utilized for multiple applications without requiring complete redesign of the AUV.

In another exemplary embodiment, the module is connected to a forward part of the AUV. The forward module can take control of the standard AUV guidance and control when attached. The forward module can be reconfigured for multiple mission applications without the need to alter the AUV configuration. This permits high fidelity vehicle intelligence to be housed in the external module, while maintaining minimal intelligence in the standard AUV configuration. This allows for low-volume production of variable external payload modules without requiring alteration of high-volume AUV production.

DRAWINGS

DETAILED DESCRIPTION

Figure 1:
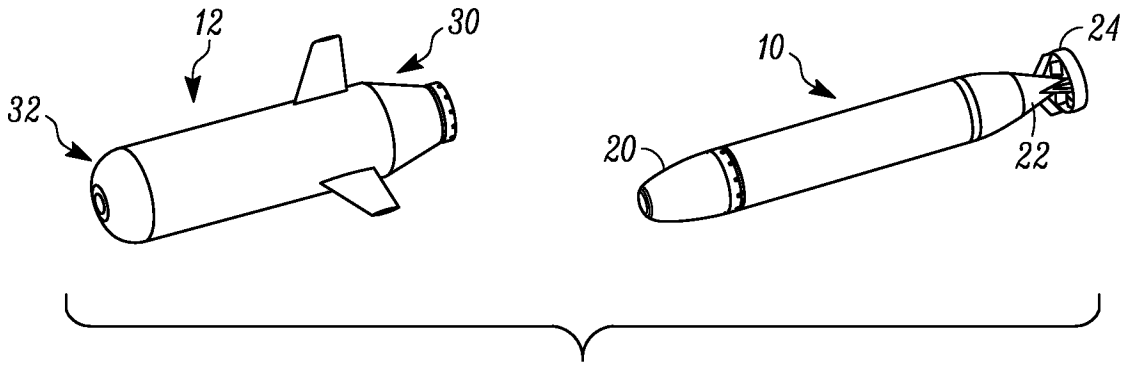
FIG. 1 is an exploded view of an AUV and an external payload module prior to connection.
Figure 2:
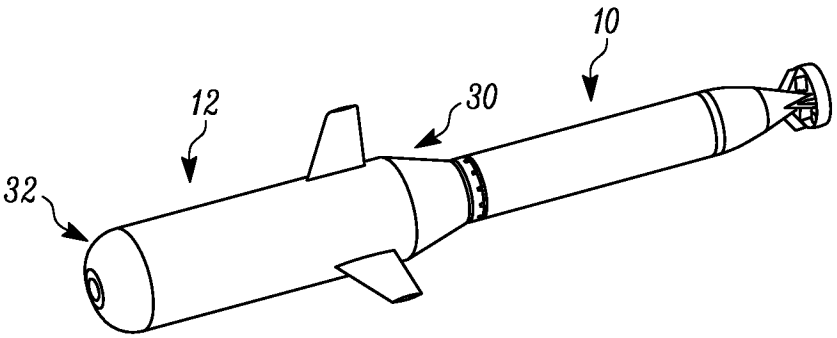
FIG. 2 illustrates the AUV and the external payload module connected together.

With reference initially to FIGS. 1-2, a standard production AUV 10 is illustrated together with an external payload module 12 that is mechanically connectable to the AUV 10.

The AUV 10 illustrated in FIGS. 1 and 2 is representative of any type of unmanned (i.e. a human does not ride on or in the AUV), high-volume, standard production, small in size underwater vehicle having a single or limited use. Specific examples of suitable AUV's that can be utilized include, but are not limited to, the MK39 EMATT from Lockheed Martin Corporation, the Iver2 from OceanServer Technology Inc., the Gavia Defence from Teledyne Gavia, and many others.

The AUV 10 generally has a front end 20 and a rear end 22, and in the illustrated embodiment has a propulsion mechanism 24, for example a propeller, at the rear end 22. As would be understood by a person of ordinary skill in the art, the front end 20 is bullet or tear drop shaped or has any other suitable shape to provide the desired hydrodynamic properties to the AUV 10. Likewise, the remainder of the AUV is shaped to provide desired hydrodynamic properties. The AUV 10 is also provided with standard, minimal guidance and control capability, and has minimal intelligence, so that the AUV is designed specifically for its intended application.

Steering of the AUV can be provided by vector or steering control of the propulsion mechanism 24 and/or by suitable control surfaces provided on the AUV 10. The propulsion mechanism 24 is powered by a suitable power supply mechanism within the AUV, for example an electric motor powered by one or more batteries.

The overall construction, including systems and operation, of the AUV 10 are known in the art.

The module 12 is mechanically connectable to the AUV 10 to become a single unit with the AUV, and is provided with one or more payload systems to enhance or expand the mission capability of the AUV 10. The exact construction of the module 12 can vary as long as the module 12 includes one or more payload systems. In addition, the module 12 can be watertight to protect the payload system(s) that it carries, should maintain the mass balance of the AUV to which it is attached, and should mirror the hydrodynamic characteristics of the AUV.

The module 12 can mechanically connect to the AUV 10 in any manner suitable so that the two systems form a single unit. For example, the module 12 can connect to the AUV 10 using screws or other fasteners. Alternatively, the module 12 and the AUV 10 can connect to one another using a quick-connect/disconnect connection of the type described in U.S. Pat. No. 8,539,898, filed on Mar. 24, 2010, titled Underwater Vehicle with Improved Controls and Modular Payload, which is incorporated herein by reference.

As shown in FIGS. 1-2, the module 12 is configured to detachably attach to the front end 20 of the AUV 10 to allow installation and removal of the module 12 for replacement of a new module. However, the module 12 can attach to any location on the AUV 10 as long as the module 12 performs the functions described herein.

Figure 3:
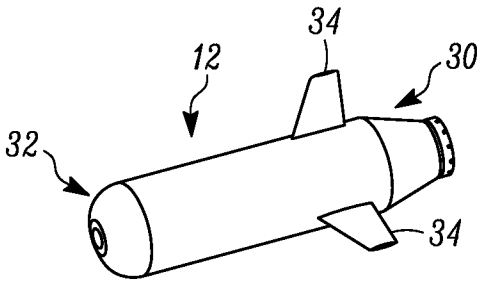
FIG. 3 is a close-up view of the external payload module.

In the embodiment illustrated in FIGS. 1-3, the module 12 includes a rear mounting section 30 that is formed as a cylindrical sleeve configured to receive and surround the front end 20 of the AUV 10. The rear mounting section 30 is used to mechanically attach the module to the AUV. The module 12 also includes a forward payload section 32 that is designed to house one or more payload systems. The front end of the section 32 is bullet or tear drop shaped or has any other suitable shape to provide the desired hydrodynamic properties to the combined AUV/module unit.

Examples of payload systems that can be included in the module 12 includes, but are not limited to, one or more of sensors such as depth and/or navigation sensors, one or more data processors to provide data processing capability, one or more power supplies such as batteries, communication equipment for transmitting and/or receiving signals, ordinance, camera(s), lights, sonar, oceanographic instrumentation and sensors, release mechanisms for buoy(s), surveillance equipment, antennas, etc.

In addition, the module 12 includes one or more control surfaces 34 such as controllable steering fins for providing enhanced steering control and lift characteristics to the combined AUV and module. The control surfaces 34 can enhance the existing steering capability of the AUV.

It is preferred that the module 12 not include its own propulsion capability. Rather, once the module 12 is mechanically attached to the AUV 10, the propulsion mechanism 24 of the AUV will be used to propel the combined AUV/module unit through the water.

In an embodiment, in addition to mechanical connection, there can be one or more I/O connections between the AUV and the module to provide data and communications interface between the two. The I/O connection(s) can be wireless, for example using a suitable short range radio communication technology, or wired, for example using one or more Ethernet connections. The I/O connection(s) can occur automatically upon mechanically mounting the module to the AUV to the module, and/or require manual connection.

In this embodiment, the module 12 can take control of the AUV, enabling variable mission controls without independent AUV modification. By removing the module 12 and replacing with a new module 12, the module 12 can be reconfigured for multiple mission applications without the need to alter the standard AUV configuration. In addition, high fidelity vehicle intelligence can be housed in the module 12, thereby maintaining minimal intelligence in the standard AUV 10.

In another embodiment, in addition to mechanical connection, there can also be one or more power connections between the AUV and the module to provide power from the module to the AUV or to provide power from the AUV to the module. The power connection(s) can occur automatically upon mechanically mounting the AUV to the module, and/or require manual connection.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A system comprising:

an autonomous underwater vehicle that includes a front end, a rear end, and a propulsion mechanism;

an external payload module that is detachably mechanically connected to the autonomous underwater vehicle, the external payload module includes at least one payload system that is configured to enhance or expand the capability of the autonomous underwater vehicle, and one or more steerable control surfaces; and the external payload module does not include a propulsion mechanism; and the external payload module includes a rear mounting section that is formed as a cylindrical sleeve that receives and surrounds the front end of the autonomous underwater vehicle.

2. The system of claim 1, wherein the external payload module is detachably mechanically attached to the front end of the autonomous underwater vehicle.

3. The system of claim 1, further comprising at least one I/O connection between the external payload module and the autonomous underwater vehicle.

4. The system of claim 1, further comprising at least one power connection between the external payload module and the autonomous underwater vehicle.

5. A system comprising:

an autonomous underwater vehicle that includes a front end, a rear end, and a propulsion mechanism;

an external payload module that is detachably mechanically connected to the autonomous underwater vehicle, the external payload module includes at least one payload system that is configured to enhance or expand the capability of the autonomous underwater vehicle, and one or more steerable control surfaces; and the external payload module does not include a propulsion mechanism;

the external payload module includes a rear mounting section that is mechanically attached to the front end of the autonomous underwater vehicle, and a forward payload section that is located at least partially forward of the front end, and the one or more steerable control surfaces are located forward of the rear mounting section; and the external payload module has a longitudinal axis that is collinear to a longitudinal axis of the autonomous underwater vehicle.

6. The system of claim 1, wherein the at least one payload system comprises one or more of a sensor, a data processor that provides data processing capability, a power supply, communication equipment for transmitting and/or receiving signals, ordinance, a camera, a light, sonar, oceanographic instrumentation, a release mechanism for a buoy, surveillance equipment, an antenna.

7. A payload module that is mechanically connectable to an autonomous underwater vehicle that includes a front end, a rear end, and a propulsion mechanism, comprising:

at least one payload system that is configured to enhance or expand the capability of the autonomous underwater vehicle when the payload module is connected thereof, and one or more steerable control surfaces; and the payload module does not include a propulsion mechanism; and the payload module includes a rear mounting section that is formed as a cylindrical sleeve that can receive and surround the front end of the autonomous underwater vehicle.

8. The payload module of claim 7, wherein the payload module is configured to be detachably mechanically attached to the front end of the autonomous underwater vehicle.

9. The payload module of claim 7, further comprising at least one I/O connection for connection to the autonomous underwater vehicle.

10. The payload module of claim 7, further comprising at least one power connection for connection to the autonomous underwater vehicle.

11. A payload module that is mechanically connectable to an autonomous underwater vehicle that includes a front end, a rear end, and a propulsion mechanism, comprising:

at least one payload system that is configured to enhance or expand the capability of the autonomous underwater vehicle when the payload module is connected thereof, and one or more steerable control surfaces; and the payload module does not include a propulsion mechanism;

the payload module includes a rear mounting section that is mechanically attachable to the front end of the autonomous underwater vehicle, and a forward payload section, and the one or more steerable control surfaces are located forward of the rear mounting section; and the payload module has a longitudinal axis that, when the payload module is connected to the autonomous underwater vehicle, is collinear to a longitudinal axis of the autonomous underwater vehicle.

12. The payload module of claim 7, wherein the at least one payload system comprises one or more of a sensor, a data processor that provides data processing capability, a power supply, communication equipment for transmitting and/or receiving signals, ordinance, a camera, a light, sonar, oceanographic instrumentation, a release mechanism for a buoy, surveillance equipment, an antenna.

13. A method of expanding the capability of an autonomous underwater vehicle that includes a front end, a rear end, and a propulsion mechanism, comprising:

detachably mechanically connecting a first external payload module to the autonomous underwater vehicle using a rear mounting section of the first external payload module that is formed as a cylindrical sleeve that receives and surrounds the front end of the autonomous underwater vehicle; the first external payload module includes at least one payload system that is configured to enhance or expand the capability of the autonomous underwater vehicle, and one or more steerable control surfaces; and the first external payload module does not include a propulsion mechanism.

14. The method of claim 13, further comprising detaching the first external payload module from the autonomous underwater vehicle and detachably mechanically connected a second external payload module to the autonomous underwater vehicle; the second external payload module includes at least one payload system that is configured to enhance or expand the capability of the autonomous underwater vehicle, and one or more steerable control surfaces; and the second external payload module does not include a propulsion mechanism.

15. The method of claim 13, wherein the at least one payload system comprises one or more of a sensor, a data processor that provides data processing capability, a power supply, communication equipment for transmitting and/or receiving signals, ordinance, a camera, a light, sonar, oceanographic instrumentation, a release mechanism for a buoy, surveillance equipment, an antenna.

* * * * *